US009461403B2

(12) United States Patent
Gao et al.

(10) Patent No.: US 9,461,403 B2
(45) **Date of Patent: *Oct. 4, 2016**

(54) ROBUST MAGNETIC CONNECTOR

(71) Applicant: Apple Inc., Cupertino, CA (US)

(72) Inventors: Zheng Gao, San Jose, CA (US); Joshua Pong, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/542,667

(22) Filed: Nov. 17, 2014

(65) Prior Publication Data

US 2015/0207267 A1 Jul. 23, 2015

Related U.S. Application Data

(63) Continuation of application No. 13/251,290, filed on Oct. 3, 2011, now Pat. No. 8,888,500.

(60) Provisional application No. 61/503,598, filed on Jun. 30, 2011.

(51) Int. Cl.
*H01R 11/30* (2006.01)
*H01R 13/62* (2006.01)
(Continued)

(52) U.S. Cl.
CPC ..... *H01R 13/6205* (2013.01); *H01R 11/30* (2013.01); *H01R 13/17* (2013.01); *H01R 13/2421* (2013.01); *Y10S 439/939* (2013.01)

(58) Field of Classification Search
CPC .. H01R 13/6205; H01R 11/30; H01R 13/17; Y10S 439/939
USPC ..... 439/38–40, 45, 129, 700, 824, 939
See application file for complete search history.

(56) References Cited

U.S. PATENT DOCUMENTS 2,170,287 A 8/1939 Kinnebrew
2,234,982 A 3/1941 Ross
(Continued)

FOREIGN PATENT DOCUMENTS

CA 2122915 A1 3/1994
CN 2523065 Y 11/2002
(Continued)

OTHER PUBLICATIONS

"Presto 9984 Control Master Heat Control with Magnetic Cord," obtained from http://www.cookingandcanning.net/pr99comaheco.html, generated Jan. 18, 2006, 1-pg.
(Continued)

*Primary Examiner* — Neil Abrams
*Assistant Examiner* — Travis Chambers
(74) *Attorney, Agent, or Firm* — Kilpatrick Townsend & Stockton, LLP

(57) ABSTRACT

Connector inserts and receptacles that are robust, easily manufactured, and provide an improved connector performance. One example may provide a connector receptacle having a power contact located in a ground surface. An insulating layer may be placed between the power contact and the ground surface. The ground surface may be curved or flat, or it may have other shapes. Another example may provide a robust connector insert. This connector insert may include a crimping piece that fits over a cable braiding and is crimped. The crimping piece may then be attached to an attraction plate. A cover or shell may be attached to provide further reinforcement. Another example may provide a connector system having a ground contact and a power contact, where the ground contact is a make-first-break-last contact.

20 Claims, 21 Drawing Sheets

(51) Int. Cl.
*H01R 13/17* (2006.01)
*H01R 13/24* (2006.01)

(56) References Cited

U.S. PATENT DOCUMENTS 3,144,527 A 8/1964 Tolegian
3,363,214 A 1/1968 Wright
3,431,428 A 3/1969 Valer
3,521,216 A 7/1970 Tolegian
3,713,370 A 1/1973 Prijn
3,786,391 A 1/1974 Mathauser
3,808,577 A 4/1974 Mathauser
3,810,258 A 5/1974 Mathauser
3,868,160 A 2/1975 Kersman
4,211,456 A 7/1980 Sears
4,317,969 A 3/1982 Riegler et al.
4,669,791 A 6/1987 Savill
4,712,234 A 12/1987 Below et al.
4,810,202 A 3/1989 Nodfelt
4,844,582 A 7/1989 Giannini
5,382,167 A 1/1995 Janson, Jr.
5,382,476 A 1/1995 Jasper
5,692,786 A 12/1997 Berger
5,696,861 A 12/1997 Schimmeyer
5,704,802 A 1/1998 Loudermilk
5,812,356 A 9/1998 O'Connor
5,829,987 A 11/1998 Fritsch et al.
5,865,645 A 2/1999 Embo et al.
5,873,737 A 2/1999 Hashizawa
5,885,100 A 3/1999 Talend et al.
5,921,783 A * 7/1999 Fritsch et al. ..... 439/38
5,941,729 A 8/1999 Sri-Jayantha
5,954,520 A 9/1999 Schmidt
6,007,363 A 12/1999 Renk
6,030,229 A 2/2000 Tsutsui
6,042,385 A 3/2000 Watanabe et al.
6,088,752 A 7/2000 Ahern
6,094,122 A * 7/2000 Sexton ..... 336/96
6,165,006 A 12/2000 Yeh et al.
6,174,194 B1 1/2001 Bleicher et al.
6,183,264 B1 2/2001 Harsanyi
6,211,581 B1 4/2001 Farrant
6,217,339 B1 4/2001 Tsubata
6,219,267 B1 4/2001 Andres
6,238,219 B1 5/2001 Wu
6,250,931 B1 6/2001 Mendelson
6,267,602 B1 7/2001 Mendelson et al.
6,340,302 B1 1/2002 Ladd
6,358,069 B2 3/2002 Yoshioka et al.
6,419,521 B2 * 7/2002 Kanagawa et al. ..... 439/582
6,431,902 B1 8/2002 Yeh
6,464,509 B1 10/2002 Emberty et al.
6,466,718 B1 10/2002 Linnell
6,478,614 B1 11/2002 De'Longhi
6,485,338 B1 11/2002 Wu
6,522,033 B1 2/2003 Nevo
6,527,570 B1 3/2003 Hartman et al.
6,528,746 B2 3/2003 DeWitt et al.
6,545,577 B2 4/2003 Yap
6,561,815 B1 5/2003 Schmidt
6,565,363 B2 5/2003 Downing
6,595,801 B1 7/2003 Leonard et al.
6,607,391 B2 8/2003 Mendelson et al.
6,616,468 B2 9/2003 Sakiyama
6,623,276 B2 9/2003 Demau Ferrerfabrega
6,727,477 B1 4/2004 Li-Chen
6,733,333 B1 5/2004 Chen
6,773,312 B2 8/2004 Bauer et al.
6,814,626 B2 11/2004 Wen-Yao
6,815,610 B2 11/2004 Kuboshima et al.
6,821,126 B2 11/2004 Neidlein
6,966,781 B1 11/2005 Bullinger et al.
6,976,882 B2 12/2005 Kernan
6,988,897 B2 1/2006 Belongia et al.
6,991,483 B1 1/2006 Milan et al.
7,032,288 B2 4/2006 Ladd
7,066,739 B2 6/2006 McLeish
7,097,499 B1 * 8/2006 Purdy ..... H01R 13/5205 439/578
7,112,103 B2 9/2006 Zhang et al.
7,121,707 B2 10/2006 Currie et al.
7,198,295 B2 4/2007 Biziorek et al.
7,217,142 B1 5/2007 Wu
7,247,046 B1 7/2007 Wu
7,264,479 B1 * 9/2007 Lee ..... 439/39
7,306,479 B1 12/2007 Wu
7,311,526 B2 * 12/2007 Rohrbach et al. ..... 439/39
7,329,128 B1 2/2008 Awad
7,332,990 B2 2/2008 Lo et al.
7,351,066 B2 4/2008 DiFonzo et al.
7,364,433 B2 4/2008 Neidlein
7,419,378 B2 9/2008 Ha et al.
7,429,188 B2 9/2008 Wu
7,445,452 B1 11/2008 Wu
7,497,693 B1 3/2009 Wu
7,498,546 B2 3/2009 Belongia et al.
7,517,222 B2 4/2009 Rohrbach et al.
7,625,213 B1 12/2009 Tse
7,641,477 B2 1/2010 DiFonzo et al.
7,645,143 B2 1/2010 Rohrbach et al.
7,717,733 B1 5/2010 Yi et al.
7,775,801 B2 8/2010 Shiff et al.
7,901,216 B2 3/2011 Rohrbach et al.
7,931,472 B2 4/2011 David et al.
7,963,773 B2 6/2011 Palli et al.
8,043,123 B2 10/2011 Hsieh
8,057,248 B1 11/2011 Sherman
8,087,939 B2 1/2012 Rohrbach et al.
8,172,580 B1 5/2012 Chen et al.
8,177,560 B2 5/2012 Rohrbach et al.
8,241,043 B1 8/2012 Lin
8,342,857 B2 1/2013 Palli et al.
8,435,042 B2 5/2013 Rohrbach et al.
8,497,753 B2 7/2013 DiFonzo et al.
8,535,088 B2 9/2013 Gao et al.
8,690,582 B2 4/2014 Rohrbach et al.
8,888,500 B2 * 11/2014 Gao ..... H01R 13/17 439/39
9,112,304 B2 8/2015 Rohrbach et al.
2002/0002004 A1 1/2002 Akama et al.
2002/0044746 A1 4/2002 Kronlund et al.
2002/0054686 A1 5/2002 Tabata et al.
2002/0123250 A1 9/2002 Wang
2003/0148643 A1 8/2003 Yoji
2004/0077187 A1 4/2004 Belongia et al.
2004/0184295 A1 9/2004 Robertson et al.
2004/0209489 A1 10/2004 Clapper
2004/0224539 A1 11/2004 Boyd et al.
2004/0257741 A1 12/2004 Cuny et al.
2005/0082915 A1 4/2005 Steinberg
2005/0208783 A1 9/2005 Suzuki et al.
2005/0255716 A1 11/2005 Heidlein
2005/0255718 A1 11/2005 McLeish
2005/0255719 A1 11/2005 Heidlein
2006/0051981 A1 3/2006 Neidlein et al.
2006/0067690 A1 3/2006 Tatum et al.
2006/0164447 A1 7/2006 Poole et al.
2007/0067654 A1 3/2007 Adachi
2007/0072443 A1 3/2007 Rohrbach et al.
2007/0085516 A1 4/2007 Fenwick et al.
2007/0107068 A1 5/2007 Kelley et al.
2007/0112989 A1 5/2007 Iwaki
2007/0184674 A1 8/2007 Koch
2008/0211310 A1 9/2008 Jitaru et al.
2009/0142962 A1 6/2009 Zhang
2009/0269943 A1 10/2009 Palli et al.
2010/0080563 A1 4/2010 DiFonzo et al.
2011/0092081 A1 4/2011 Gao et al.
2011/0136350 A1 * 6/2011 Palli et al. ..... 439/39
2012/0148196 A1 6/2012 Penumatcha et al.
2012/0295451 A1 11/2012 Hyun-Jun et al.
2013/0040470 A1 2/2013 Gao et al.
2013/0065406 A1 3/2013 Rohrbach et al.
2013/0316549 A1 11/2013 DiFonzo et al.

(56) References Cited

U.S. PATENT DOCUMENTS

| | | | |
|---|---|---|---|
| 2014/0087569 | A1 | 3/2014 | Lee |
| 2014/0235075 | A1 | 8/2014 | Kim et al. |
| 2014/0285957 | A1 | 9/2014 | Rohrbach et al. |
| 2014/0287601 | A1 | 9/2014 | Suh |
| 2015/0111398 | A1 | 4/2015 | Isenhour et al. |
| 2015/0214654 | A1 | 7/2015 | Huang |

FOREIGN PATENT DOCUMENTS

| | | | |
|---|---|---|---|
| CN | 201252244 | Y | 6/2009 |
| CN | 10 151 5685 | A | 8/2009 |
| CN | 102074824 | A | 5/2011 |
| DE | 3904708 | C1 | 1/1990 |
| DE | 3622948 | A1 | 1/1998 |
| DE | 19820691 | A1 | 2/1999 |
| DE | 102 42 645 | A1 | 3/2004 |
| DE | 20 2004 003 202 | U1 | 6/2004 |
| DE | 103 33 403 | A1 | 9/2004 |
| DE | 202010002522 | U1 | 7/2010 |
| EP | 0 112 019 | A1 | 6/1984 |
| EP | 0 573 471 | B1 | 10/1984 |
| EP | 0 289 208 | A2 | 11/1988 |
| EP | 1 194 983 | B1 | 9/2003 |
| FR | 2 566 195 | A1 | 12/1985 |
| FR | 2665305 | A1 | 1/1992 |
| FR | 2 685 981 | A1 | 7/1993 |
| GB | 1232922 | B1 | 5/1971 |
| GB | 2174556 | A | 11/1986 |
| GB | 2383476 | A | 6/2003 |
| JP | 50-9990 | B | 4/1975 |
| JP | 03-059973 | | 3/1991 |
| JP | 4-296475 | A | 10/1992 |
| JP | 05-335051 | | 12/1993 |
| JP | 7-6817 | A | 1/1995 |
| JP | 11-09467 | A | 1/1999 |
| JP | 11-144803 | A | 5/1999 |
| JP | 11-273770 | A | 10/1999 |
| JP | 2000/12145 | A | 1/2000 |
| JP | 2000/30806 | A | 1/2000 |
| JP | 2002/056929 | A | 2/2002 |
| JP | 2002-270279 | A | 9/2002 |
| JP | 2002/367724 | A | 12/2002 |
| JP | 2003/082519 | A | 3/2003 |
| JP | 2003-163046 | A | 6/2003 |
| JP | 2004/206973 | A | 7/2004 |
| JP | 2006-095040 | A | 4/2006 |
| WO | 94/06174 | A1 | 3/1994 |
| WO | 95/06970 | A1 | 3/1995 |
| WO | 2004/027937 | A1 | 4/2004 |
| WO | 2004/095647 | A1 | 11/2004 |
| WO | 2005/006913 | A1 | 1/2005 |
| WO | 2011/049838 | A1 | 4/2011 |

OTHER PUBLICATIONS

National Presto Industries, Inc., "Magnetic Cord for Electric Deep Fryers," obtained from http://www.gopresto.com/productslproducts.php?stock=09982. generated Jan. 18, 2006, 1-pg.
Dowell Trading Co, Ltd.,"News for Break Away Power Cords on Electric Deep Fryers," copyright 2002, 1-pg.
CNN.com, "Break-away cord aims to make deep fryers safer," obtained from http:/larchives.cnn.com/2001/US/07/03/deep.fryers/, dated Jul. 4, 2001, 2-pgs.
"Zojirushi Hot Water Dispensing Pot Review," obtained from http://www.pkshiu.comtlof/archive/2005/01/zojirushi-hot-water-dispensing-pot-review, dated Jan. 5, 2005, 2-pgs.
U.S. Consumer Product Safety Commission, "Consumer Product Safety Review," Winter 2002, vol. 6, No. 3, total of 12-pgs., see p. 5.
English Abstract of JP2002056929 to Zojirushi Corp, obtained from http://esp@cenet.com, 1-pg, Aug. 12, 2005.
Search/Examination Report dated Aug. 3, 2009 from European Patent Application No. 09159211.3, 8 pages.
Search/Examination Report dated Dec. 6, 2010 from European Patent Application 10 011 084.0.24.
Search/Examination Report dated Dec. 3, 2010 from European Patent Application 10 011 081.6.
Search/Examination Report dated Mar. 3, 2011 from Great Britain Patent Office; GB1101348.9.
International Search Report dated Dec. 12, 2006 from PCT Patent Application No. PCT/US2006/031525.
Search/Examination Report dated Dec. 6, 2010 from European Patent Application 10 011 082.4.
Partial Search Report dated Dec. 6, 2010 from European Patent Application 10 011 083.2.
Search/Examination Report dated Mar. 30, 2011 from European Patent Application 10 011 083.2.
Partial Search Report dated Dec. 6, 2010 from European Patent Application 10 011 084.0.
Search/Examination Report dated Mar. 30, 2011 from European Patent Application 10 011 084.0.
Search/Examination Report dated Oct. 19, 2011 from European Patent Application 11176682.0.
International Search Reported dated Sep. 25, 2012, from PCT Patent Application No. PCT/US2012/045056, 11 pages.
International Search Report dated Oct. 17, 2012, from PCT Patent Application No. PCT/US2012/049870, 16 pages.
Translation of De 20 2010 002 522 U1, Chen Ming Jen [TW]; Voit Stegan [DE], Jul. 8, 2010, pp. 1-6.

* cited by examiner

ROBUST MAGNETIC CONNECTOR

CROSS-REFERENCES TO RELATED APPLICATIONS

This application is a continuation of U.S. patent application Ser. No. 13/251,290, filed Oct. 3, 2011, which claims the benefit of U.S. provisional patent application No. 61/503,598, filed Jun. 30, 2011, which are incorporated by reference.

BACKGROUND

The number and types of electronic devices available to the public has increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

In some instances, these connector inserts may be left in place for long periods of time. In other applications though, a cable may be disconnected from an electronic device on a regular basis. This repeated connection and disconnection may lead to wear and damage to the connector inserts and receptacles. For these reasons, it may be desirable to provide robust connector inserts and receptacles.

Also, a user's experience in connecting and disconnecting these cables may do a lot to inform the user's opinion of the device itself. Accordingly, it may be desirable to provide connectors that function well and provide an improved performance.

Thus, what is needed are connector inserts and receptacles that may be robust, easily manufactured, and improve connector performance.

SUMMARY

Accordingly, embodiments of the present invention provide connector inserts and receptacles that are robust, easily manufactured, and provide an improved connector performance.

An illustrative embodiment of the present invention may provide a connector receptacle having a power contact located in a ground surface. An insulating layer may be placed between the power contact and the ground surface. The ground surface may be curved or flat (or substantially planar), or it may have other shapes. The power contact may be formed of a highly conductive material, such as brass, copper-nickel-silicon alloy, or a silver alloy. The ground surface may cover a plurality of magnets arranged to be attracted to a magnetic element in a connector receptacle. To avoid shunting the resulting magnetic field, the ground surface may be formed of a less magnetically conductive material, such as low carbon steel (1010), titanium, stainless or other steel, or other appropriate material, and it may be relatively thin. To increase the ground surface's current capability, it may be made relatively large. A spring may be included behind the power contact to help keep the power contact connected to a contact in a connector insert. The spring may be formed using Titanium Copper, Phosphor-bronze, or other appropriate material.

Another illustrative embodiment of the present invention may provide a robust connector insert. This connector insert may include a crimping piece that fits over a cable braiding and is crimped. The crimping piece may then be attached to an attraction plate. The attraction plate may be formed using low carbon steel (1010), magnetic stainless steel, or other ferromagnetic material. A cover or shell may be attached to provide further reinforcement. The shell may be formed of aluminum (for example, to match a device enclosure) or other material.

Another illustrative embodiment of the present invention may provide a connector system having a ground contact and a power contact where the ground contact is a make-first-break-last contact. This connector system may include a connector receptacle or connector insert where a ground contact is located in front of a power contact.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
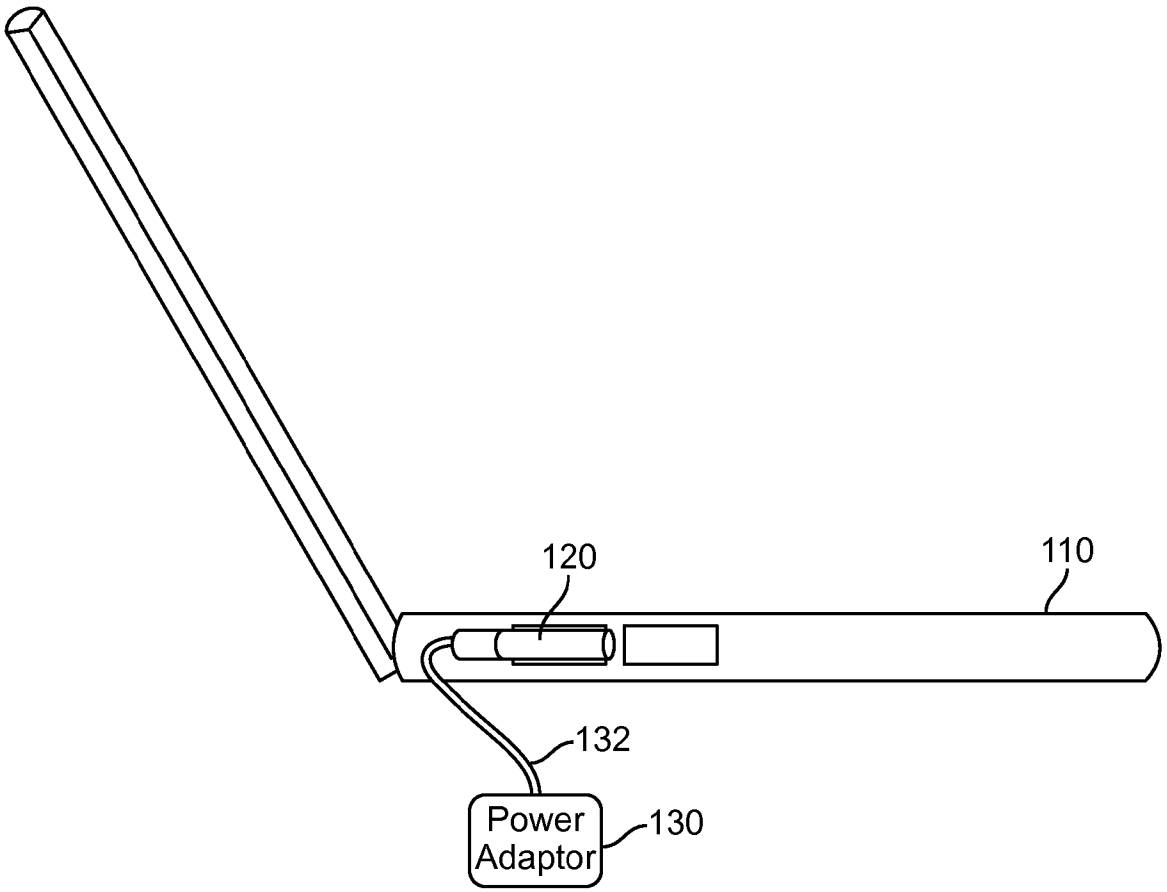
FIG. 1 illustrates an electronic system that may be improved by the incorporation of an embodiment of the present invention.

FIG. 1 illustrates an electronic system that may be improved by the incorporation of an embodiment of the present invention. This figure illustrates a laptop 110 being charged by power adapter 130 via magnetic connector 120 and cable 132. Power adapter 130 may receive power from a wall outlet, vehicle charger, or other power source. Power adapter 130 may transform this received power to a form that may be used to charge a battery (not shown) in laptop 110. In this example, power adapter 130 is shown charging a laptop 110, though in other embodiments of the present invention, other electronic devices, such as portable computing devices, tablet, desktop, and all-in-one computers, cell, smart, and media phones, storage devices, portable media players, navigation systems, monitors and other devices, may be charged.

Magnetic connector 120 may be a connector insert that is part of a magnetic connector system that includes a connector insert and connector receptacle. Examples of such connector inserts and connector receptacles consistent with embodiments of the present invention are shown in the following figures.

Figure 2:
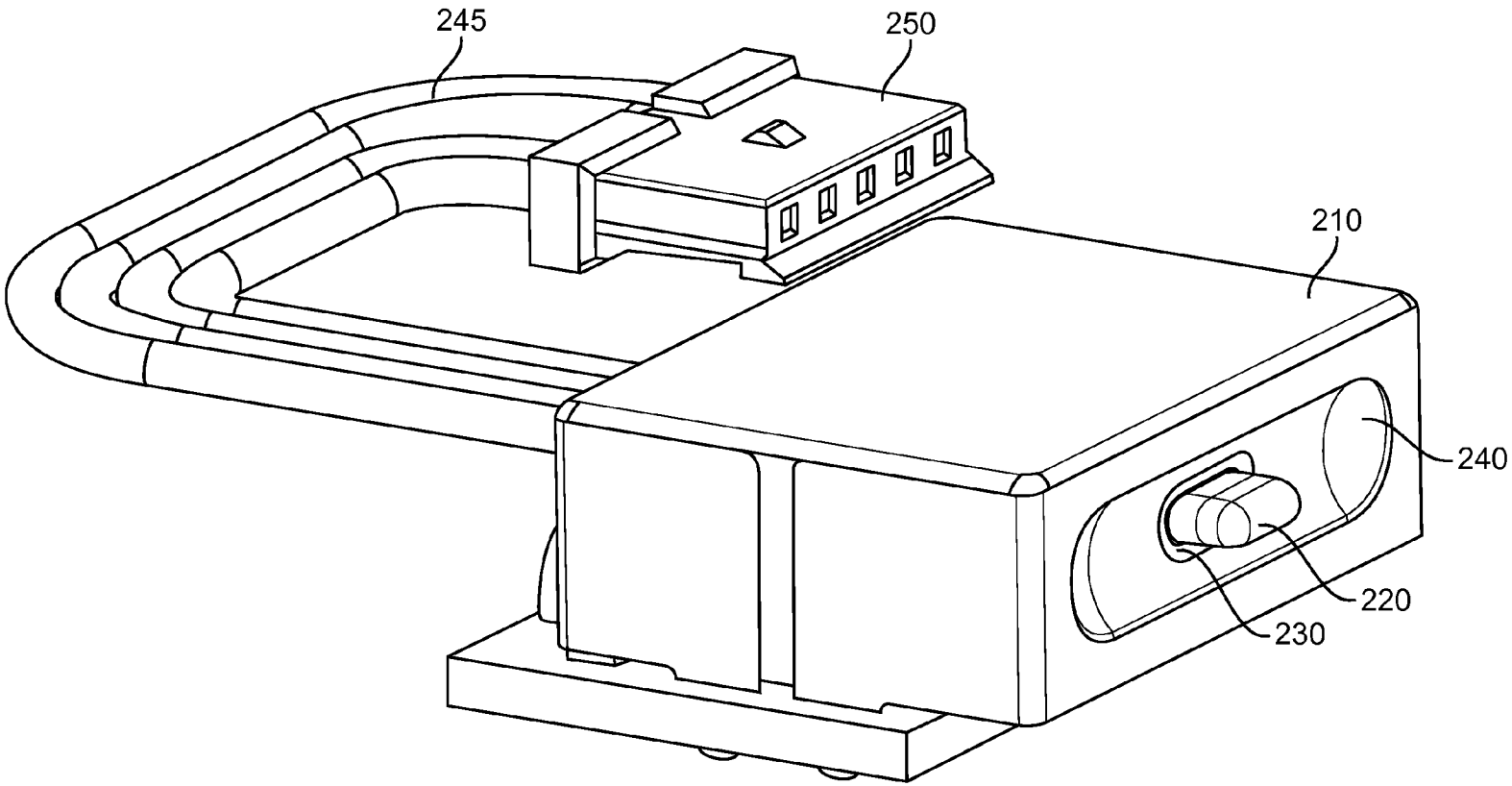
FIG. 2 illustrates a connector receptacle according to an embodiment of the present invention.

FIG. 2 illustrates a connector receptacle 210 according to an embodiment of the present invention. This figure, as with the other included figures, is shown for illustrative purposes and does not limit either the possible embodiments of the present invention or the claims.

Connector receptacle 210 may be located in an electronic device such as a portable computing device, tablet, desktop, or all-in-one computer, cell, smart, and media phone, storage device, portable media player, navigation system, monitor or other device. An enclosure for the device may include an opening such that surface 240 and contact 220 are accessible to a connector insert.

Connector receptacle 210 includes connector pin 220. Connector pin 220 may receive a positive voltage and may carry current provided by a power adapter or other device to a device that includes connector receptacle 210. Alternatively, connector pin 220 may provide a positive voltage and may provide power and current to an external device. Connector pin 220 may be made relatively small by using material having a high conductivity. The power contact connector pin 220 may be formed of a highly conductive material, such as brass, copper-nickel-silicon alloy, or a silver alloy.

An insulating portion 230 may isolate the positive supply on contact pin 220 from ground surface 240. Ground surface 240 may act as a ground return, as well as a portion of a shield surrounding the connector receptacle. Ground surface 240 may have a curved surface as shown for easy insertion and extraction of a connector insert.

In various embodiments of the present invention, magnets located in connector receptacle 210 may attract a magnetic element in a connector insert. In other embodiments of the present invention, magnets located in a connector insert may attract a magnetic element located in the connector receptacle 210. In a specific embodiment of the present invention, magnets may be located behind ground surface 240. These magnets may attract a magnetic element, such as an attraction plate made of a ferromagnetic material, in a connector insert.

In order to maintain a strong magnetic field between magnets in connector receptacle 210 and a connector insert, ground surface 240 may be made relatively thin. Also, to avoid shunting the magnetic field away from the connector insert, ground surface 240 may be made of a relatively low conductivity material.

Accordingly, to compensate for ground surface 240 being formed of a thin, low-conductivity material, ground surface 240 may be made relatively large. This provides a larger surface for the magnets to attract a connector insert, and also provides an adequate ground return path. Ground surface 240 may be formed using low carbon steel (1010), titanium copper, silver alloy, stainless or other steel, or other appropriate material. In this and other embodiments of the present invention, ground surface 240 may be formed as part of a shield for connector receptacle 210.

Figure 3:
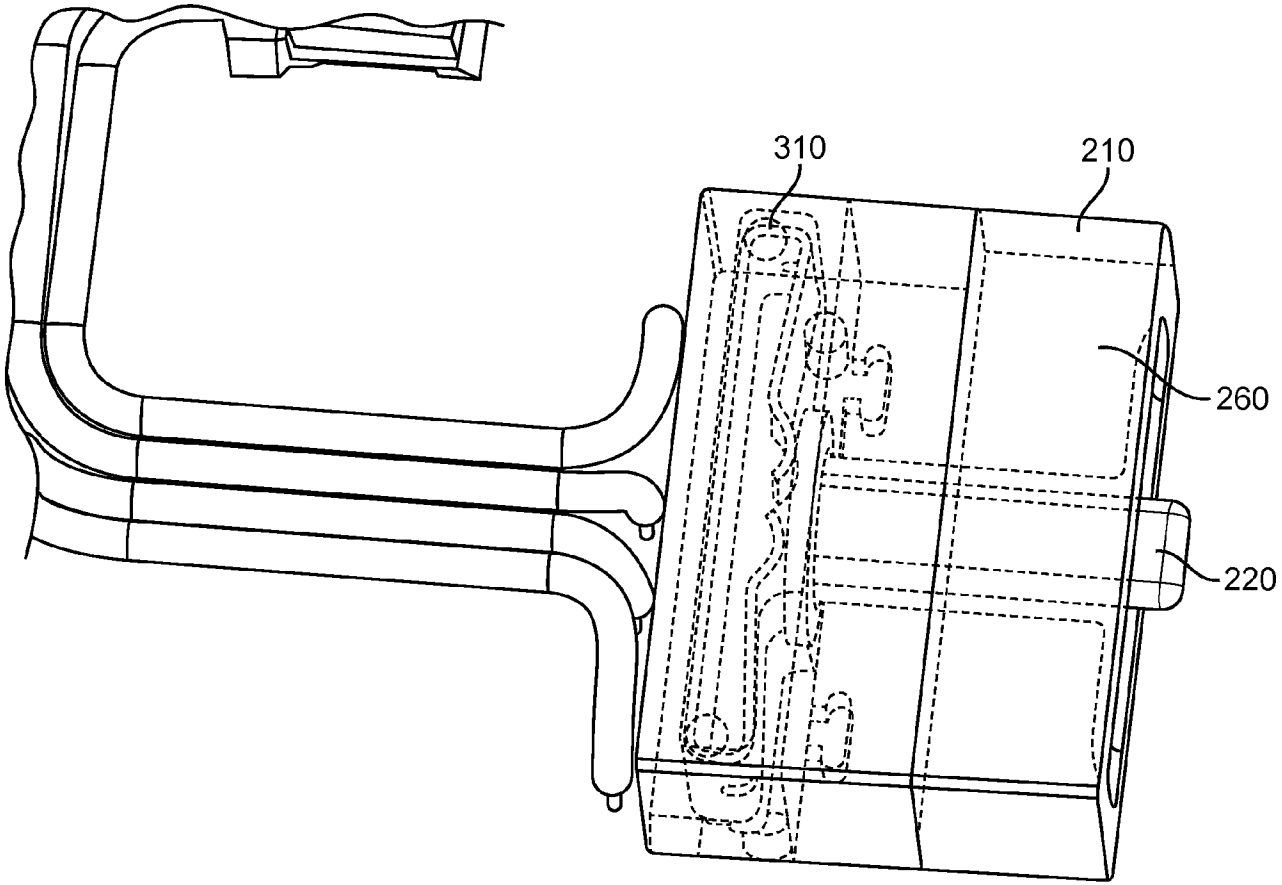
FIG. 3 illustrates a cutaway view of a connector receptacle according to an embodiment of the present invention.

FIG. 3 illustrates a cutaway view of a connector receptacle according to an embodiment of the present invention. In this example, magnets 260 can be seen as being located behind ground surface 240. In various embodiments of the present invention, various numbers of magnets may be used. For example, three, four, or other numbers of magnets may be used. These magnets may have alternating polarities to increase magnetic attraction. These magnets may be rare-earth, electromagnets, or other types of magnets.

Connector receptacle 210 further includes a spring 310. This spring is looped back onto itself as can be seen, and placed behind contact pin 220. Spring 310 may be formed using Titanium Copper (for example, Ti—Cu NKT322 EH), Phosphor-bronze (for example, C5210R-H), or other appropriate material. When connector receptacle 210 is mated with a connector insert, contact pin 220 may be depressed and may compress spring 310. Spring 310 may thus provide a force to keep contact pin 220 in electrical contact with a corresponding contact on a connector insert. An example of such a connector insert is shown in the following figure.

Figure 4:
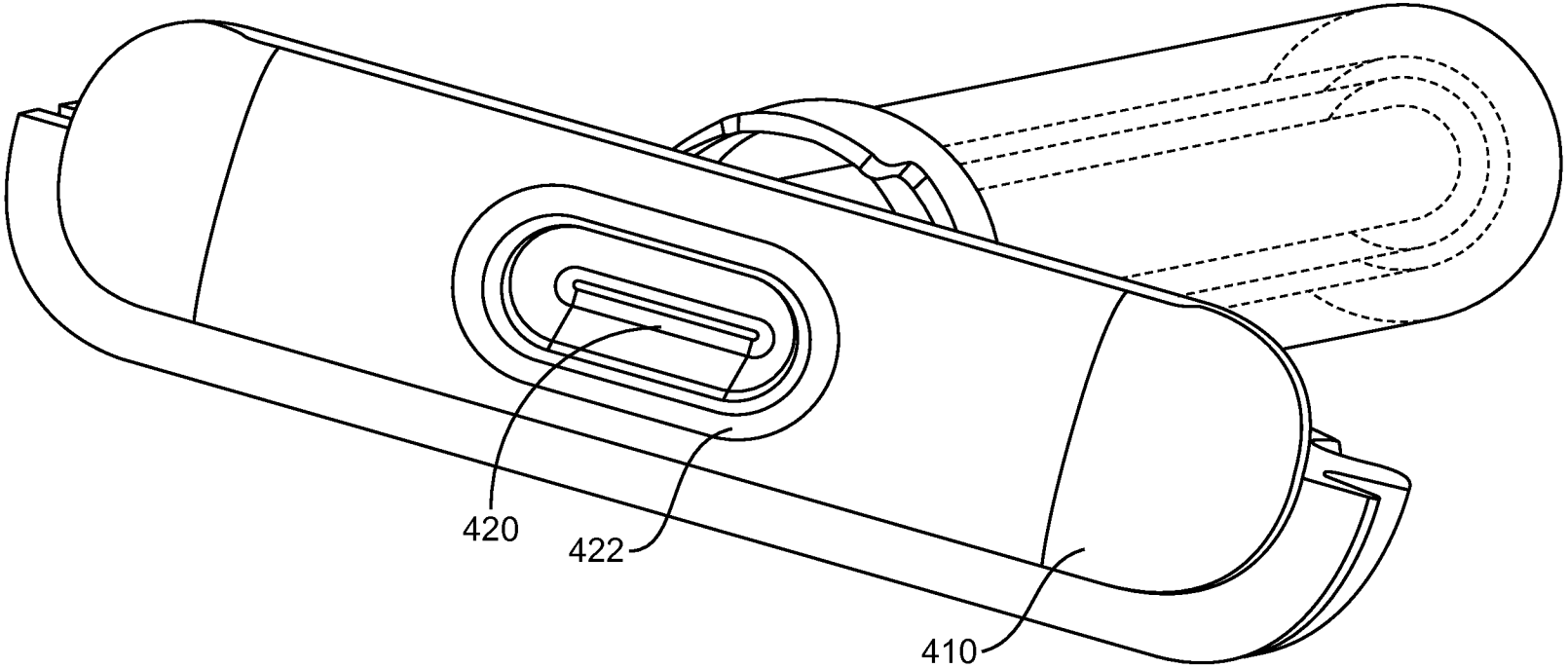
FIG. 4 illustrates a portion of a connector insert according to an embodiment of the present invention.

FIG. 4 illustrates a portion of a connector insert according to an embodiment of the present invention. This connector insert includes an attraction plate 410 and contacts 420. An insulation area 422 may isolate contact 420 from attraction plate 410.

Attraction plate 410 may be made of low carbon steel, magnetic stainless steel, a ferromagnetic material, one or more magnets, or other appropriate material. Attraction plate 410 may form a portion of a ground path. Attraction plate 410 may be curved to mate with ground surface 240 in connector receptacle 210. Contacts 420 may similarly be curved to accept contact pin 220 in connector receptacle 210. Again, the curved shapes of attraction plate 410 and contacts 420 provide for a smooth and nonbinding insertion and extraction of the connector insert. The power contact 420 may be formed of a highly conductive material, such as brass, copper-nickel-silicon alloy, or a silver alloy.

Figure 5:
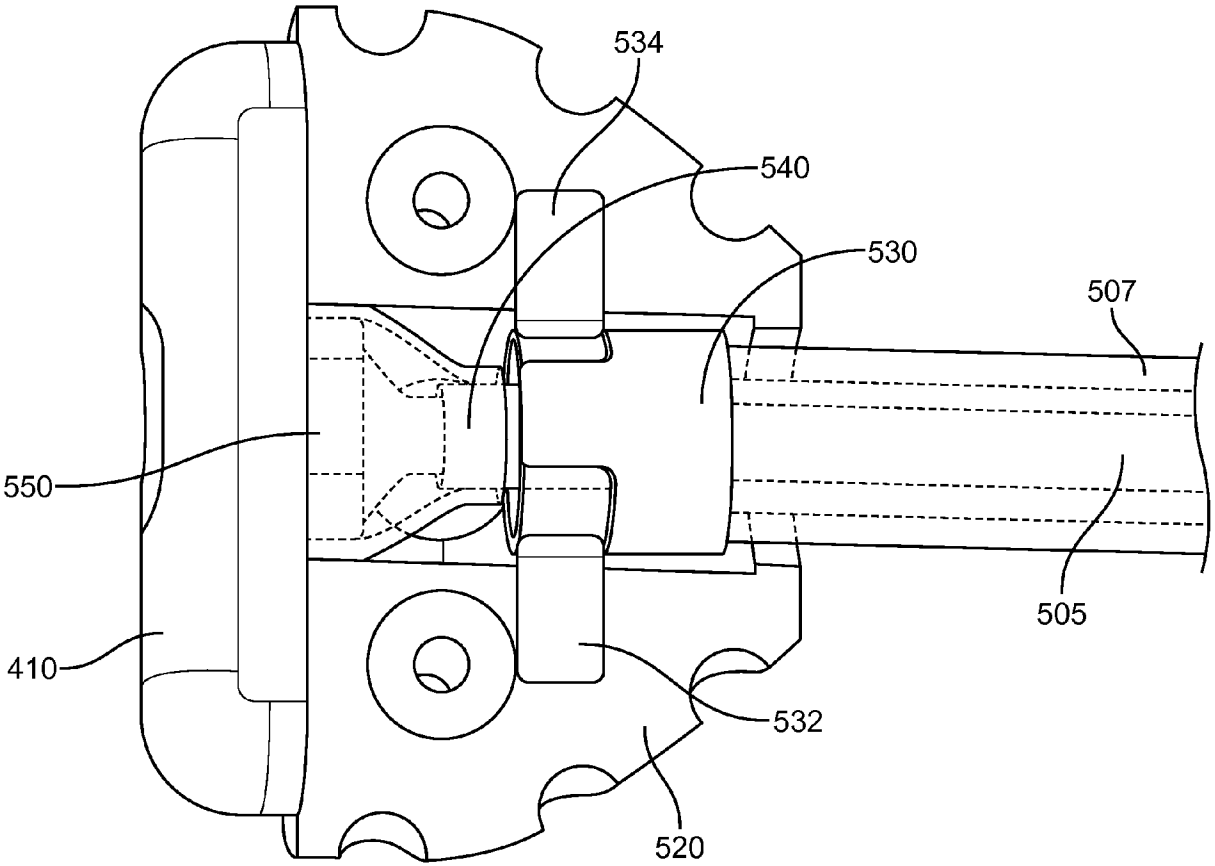
FIG. 5 illustrates a top view of a connector insert according to an embodiment of the present invention.

FIG. 5 illustrates a top view of a connector insert according to an embodiment of the present invention. In this example, cable 505 includes a center conductor surrounded by braiding 540. Braiding 540 may be pulled back around an insulating jacket 507. A crimping piece 530 may be placed over braiding 540 and compressed, thereby making contact with braiding 540. Crimping piece 530 may include portions 532 and 534, which may be spot-welded, soldered, or otherwise fixed to connector insert portion 520. A center conductor may contact metal portion 550, which in turn may connect to, or be part of, contact 420.

In this way, a power path is formed through a conductor in cable 505, the conductor connected to piece 550, which in turn is connected to, or formed as part of, contact 420. A ground path is formed through braiding 540 of cable 505, which contacts crimping piece 530, which connects to metal piece 520 via tabs 534 and 532. Attraction plate 410 may be connected to, or may be formed of, the same piece, as connector insert portion 520.

Figure 6:
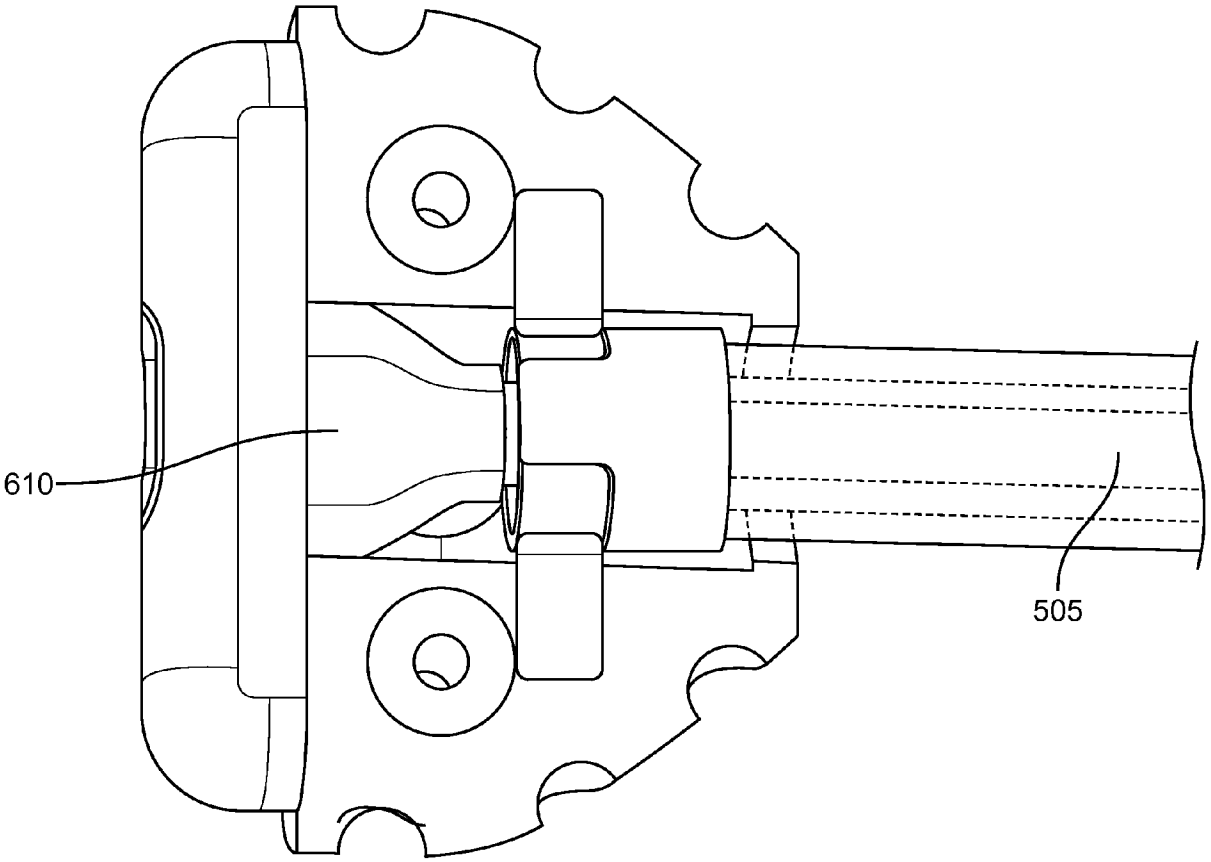
FIG. 6 illustrates a portion of a connector insert according to an embodiment of the present invention.

FIG. 6 illustrates a portion of a connector insert according to an embodiment of the present invention. In this example, heat shrink tube 610 has been placed over an end of cable 505.

Figure 7:
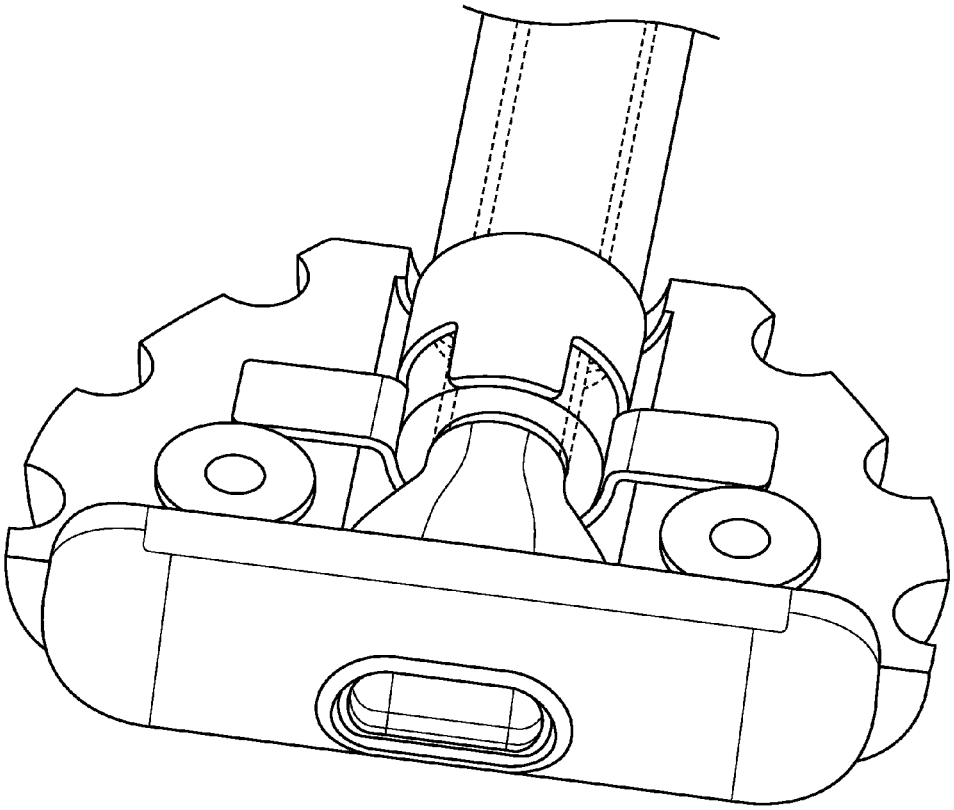
FIG. 7 illustrates a front view of a portion of a connector insert according to an embodiment of the present invention.

FIG. 7 illustrates a front view of a portion of a connector insert according to an embodiment of the present invention.

Figure 8:
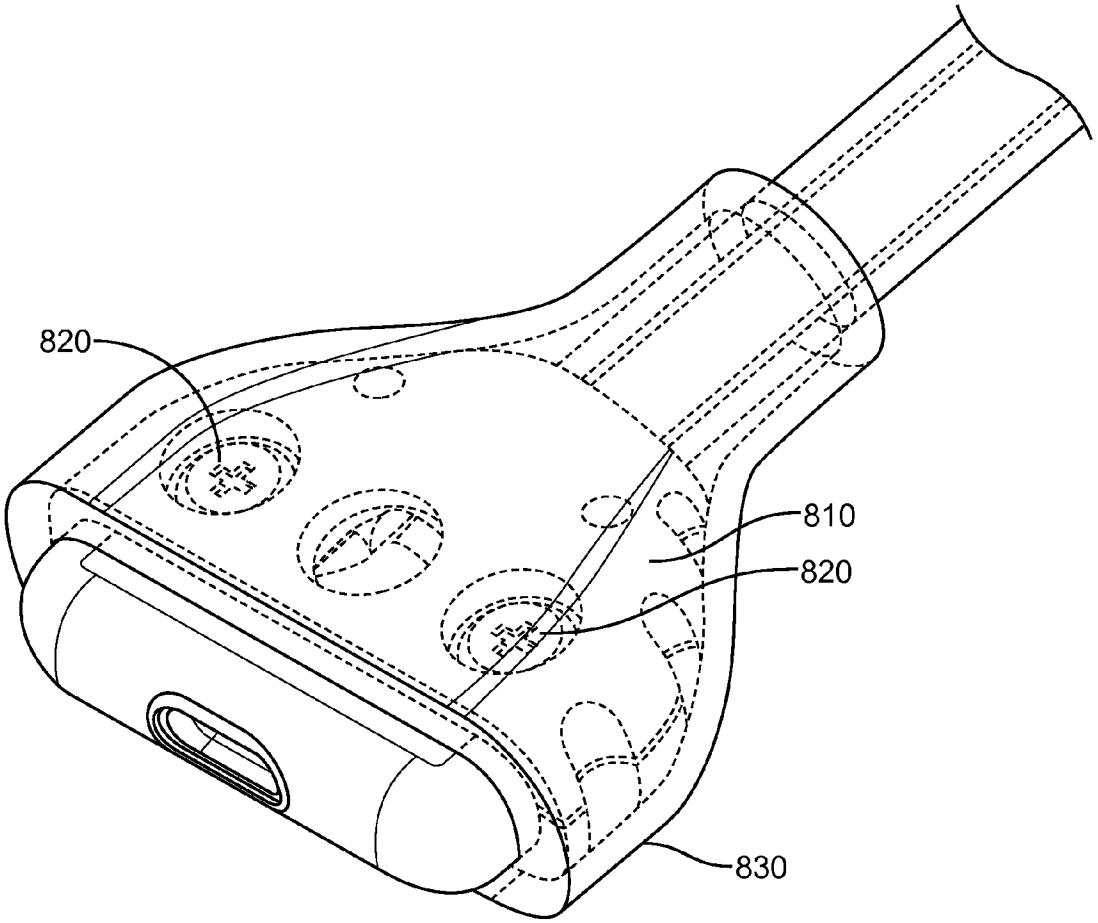
FIG. 8 illustrates a top view of a connector insert according to an embodiment of the present invention.

FIG. 8 illustrates a top view of a connector insert according to an embodiment of the present invention. In this example, top piece 810 has been fixed to the connector insert using fasteners 820. An over-mold 830, which may be soft plastic or other material, is placed over the connector insert to provide electrical isolation and a surface that may be handled by a user.

Again, connector receptacles in connector inserts according to an embodiment of the present invention may be useful in providing power to a laptop computer. In this case, a connector insert may plug into a side of the laptop, as shown in FIG. 1. In this case, the weight of the cable may pull down on the connector insert. In a worst-case situation, the cable may pull down sufficiently to disconnect a connector insert from its connector receptacle. Accordingly, embodiments of the present invention may adjust one or more dimensions in a connector receptacle to prevent this. For example, embodiments of the present invention may provide a slight bind to a disconnect that occurs in a downward direction, while allowing an upward tug to easily disconnect a connector insert from the connector receptacle. One example of how to do this is shown in the following figure.

Figure 9:
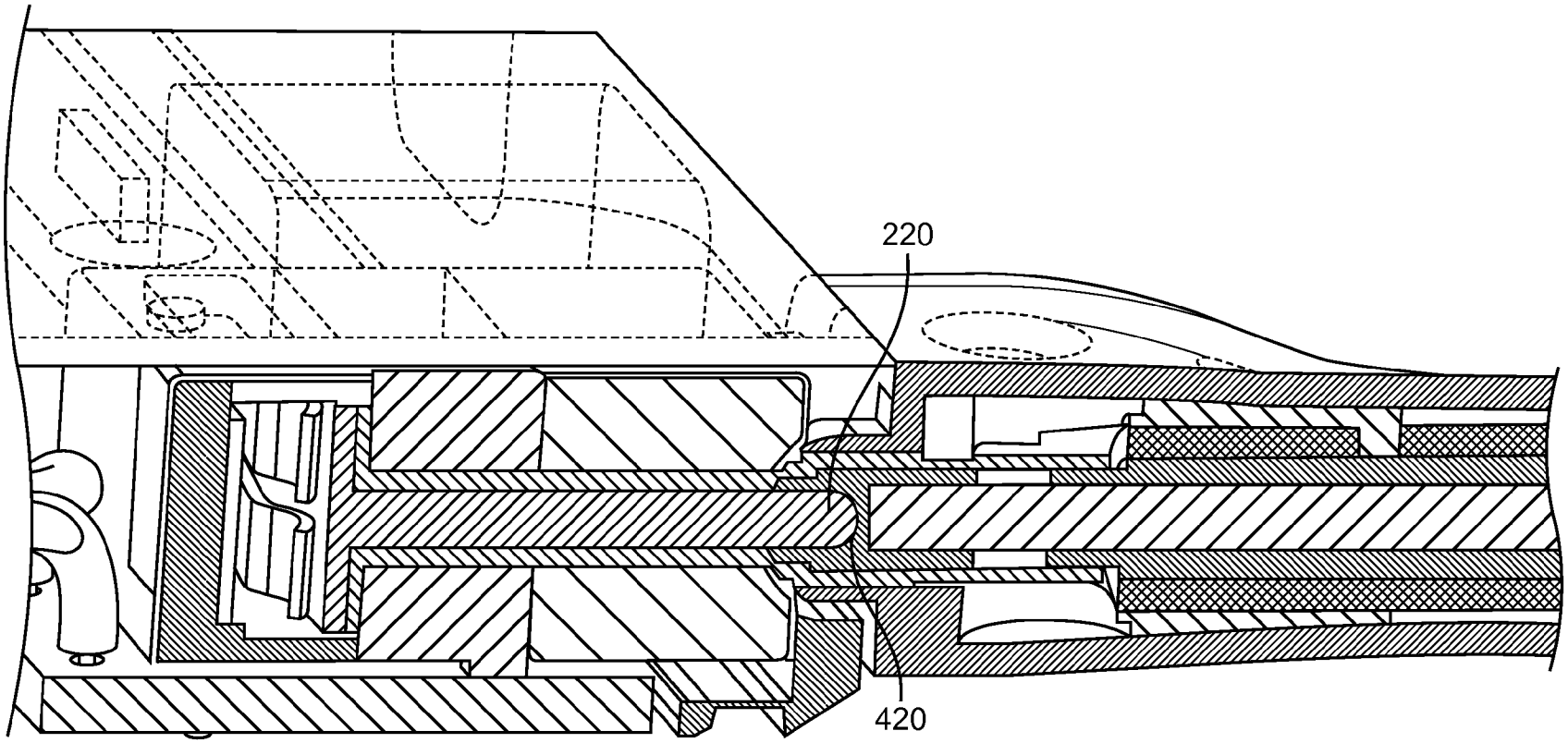
FIG. 9 illustrates a cross-section of a connector insert and a connector receptacle according to an embodiment of the present invention.

FIG. 9 illustrates a cross-section of a connector insert and a connector receptacle according to an embodiment of the present invention. In this example, contact pin 220 in a connector receptacle mates with contact 420 in a connector insert. By lowering contact pin 220 in a downward direction, the connector insert may bind somewhat when pulled in a downward direction. The displacement of contact pin 220 may also allow the connector insert to be removed more easily when pulled in an upward direction.

In the above examples, mating surfaces between a connector receptacle and the connector insert are shown as being curved. While this may have desirable properties as far as making for a smooth insertion and extraction of a connector insert from a connector receptacle, various manufacturing difficulties may be encountered. Accordingly, embodiments of the present invention may provide connector receptacles and connector inserts having flatter surfaces. Examples are shown in the following figures.

Figure 10:
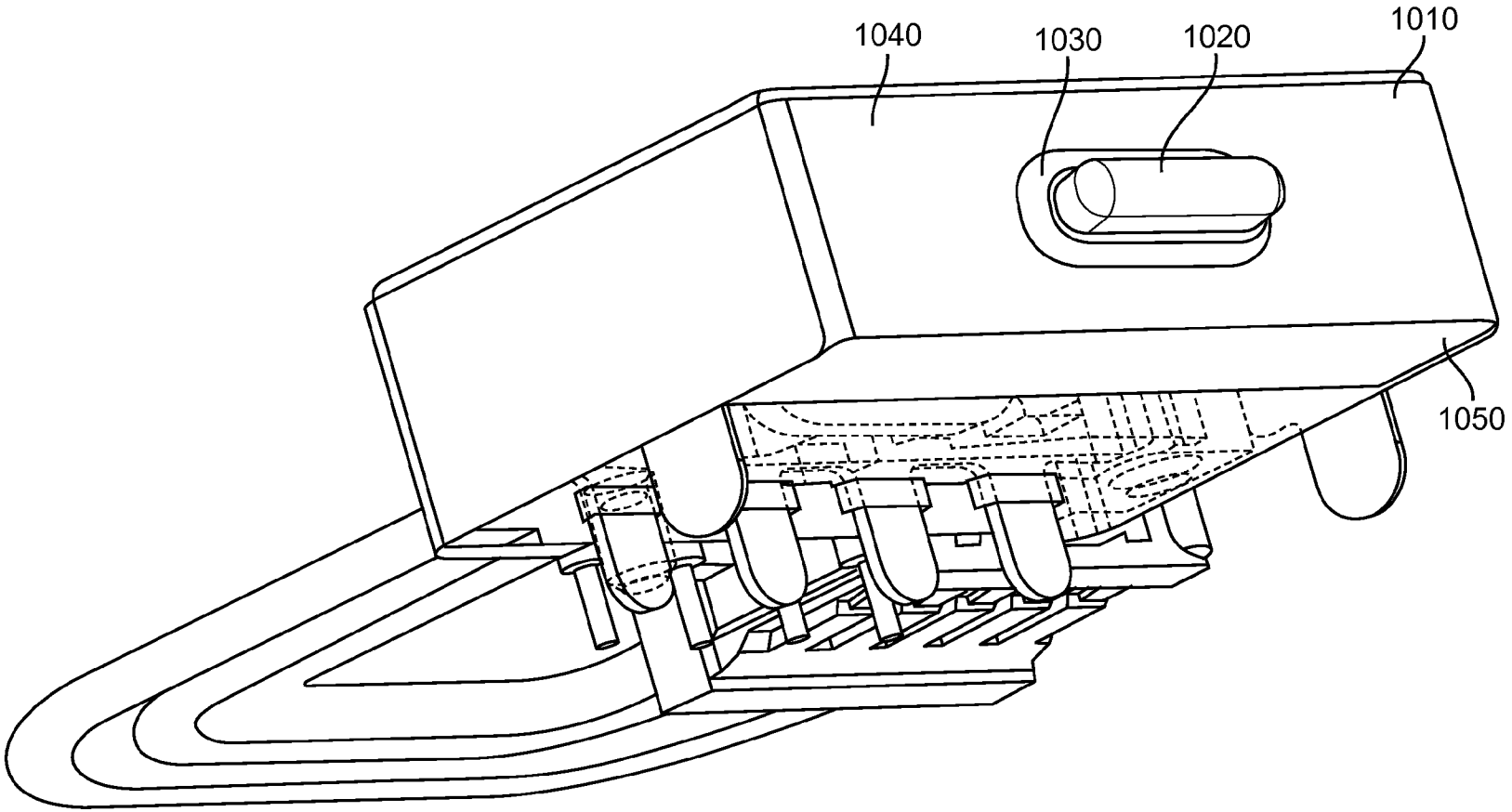
FIG. 10 illustrates a connector receptacle according to an embodiment of the present invention.

FIG. 10 illustrates a connector receptacle according to an embodiment of the present invention. Connector receptacle 1010 includes contact pin 1020, ground surface 1040, and insulation ring 1030. As before, magnets 1050 may be located behind ground surface 1040. Also as before, contact 220 may be formed of a highly conductive material. The power contact pin 1020 may be formed of a highly conductive material, such as brass, copper-nickel-silicon alloy, or a silver alloy. Ground surface 1040 may be made of a less conductive material, as described above. For example, ground surface 1040 may be formed using low carbon steel (1010), titanium copper, silver alloy, stainless or other steel, or other appropriate material. Accordingly, ground surface 1040 may be made relatively large. Also, in this embodiment of the present invention, ground surface 1040 is relatively flat, as compared to ground surface 240, and is also relatively larger.

Figure 11:
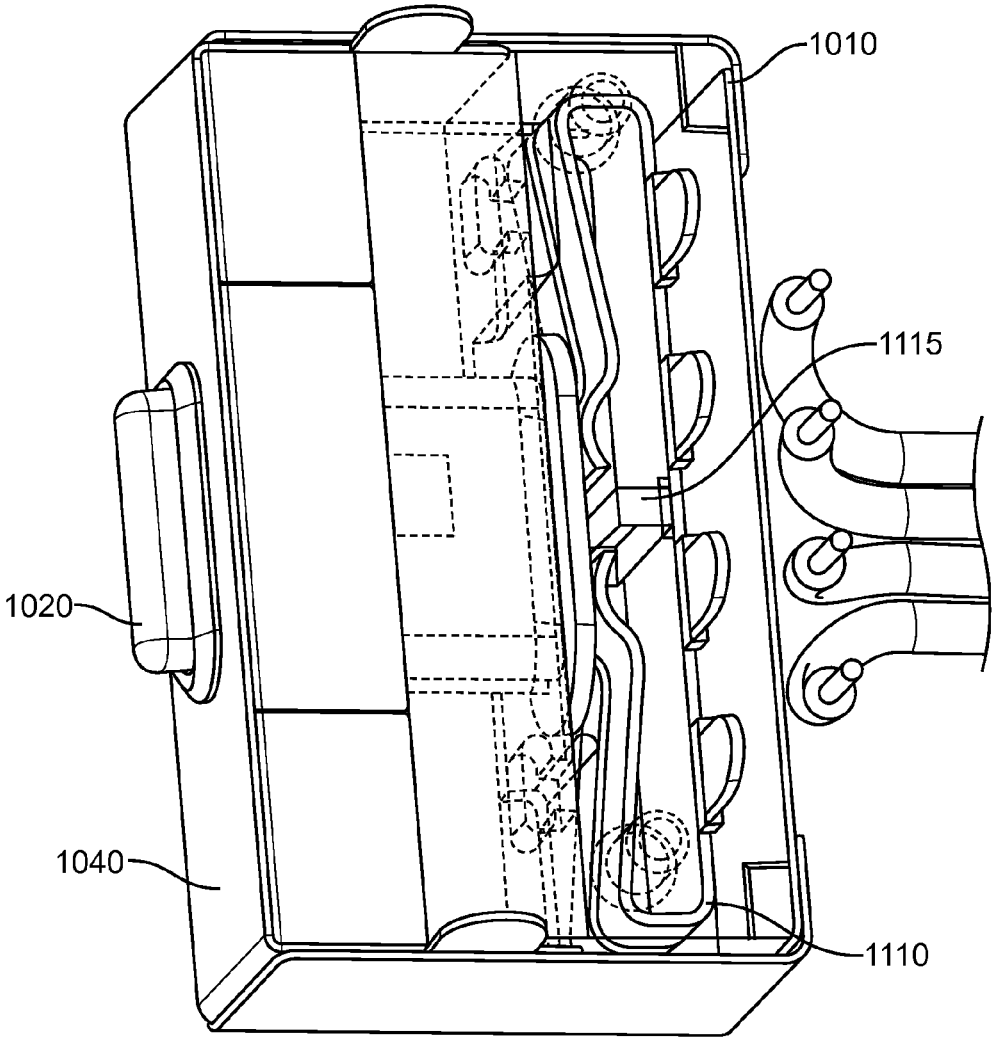
FIG. 11 illustrates a cutaway view of a connector receptacle according to an embodiment of the present invention.

FIG. 11 illustrates a cutaway view of a connector receptacle according to an embodiment of the present invention. As before, a spring 1110 may be used to provide a force to keep contact pin 1020 in contact with a contact on a connector insert when the connector insert is engaged with connector receptacle 1010. In this example, stop 1115 may be provided to limit the distance that contact pin 1020 may be depressed into connector receptacle 1010. Spring 1110 may be formed using Titanium Copper (for example, Ti—Cu NKT322 EH), Phosphor-bronze (for example, C5210R-H), or other appropriate material.

Figure 12:
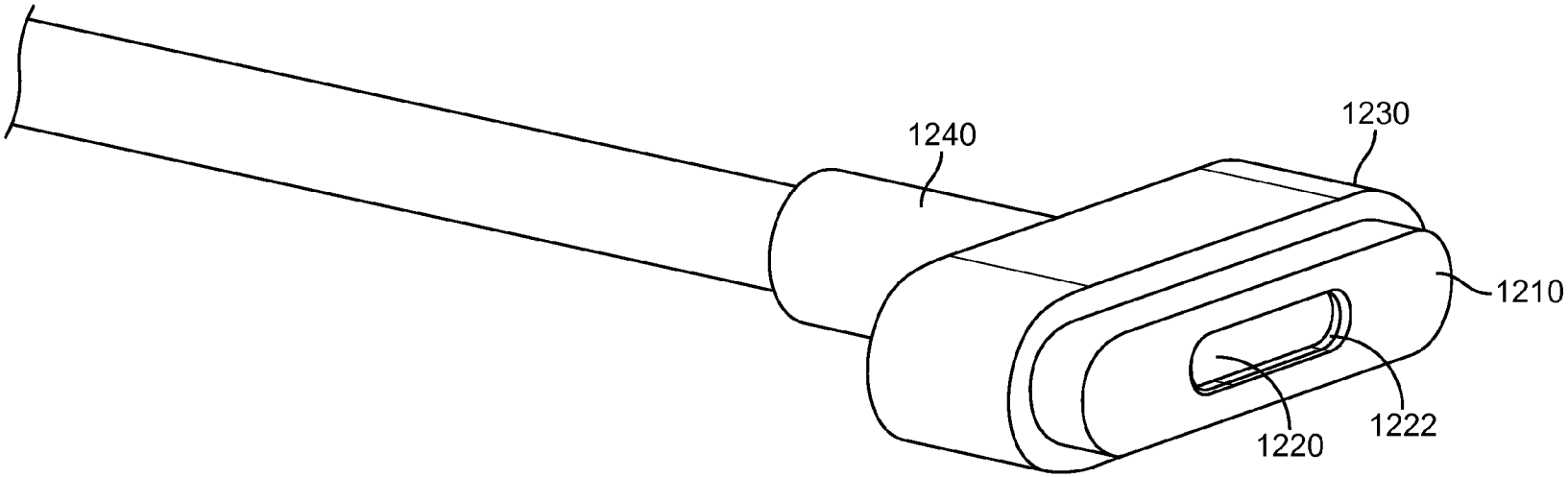
FIG. 12 illustrates a connector insert according to an embodiment of the present invention.

FIG. 12 illustrates a connector insert according to an embodiment of the present invention. This connector insert includes contact 1220, insulating layer 1222, and attraction plate 1210. Connector further includes a shell 1230 and strain relief 1240. The power contact 1220 may be formed of a highly conductive material, such as brass, copper-nickel-silicon alloy, or a silver alloy. Shell 1230 may be formed using aluminum or other material.

Figure 13:
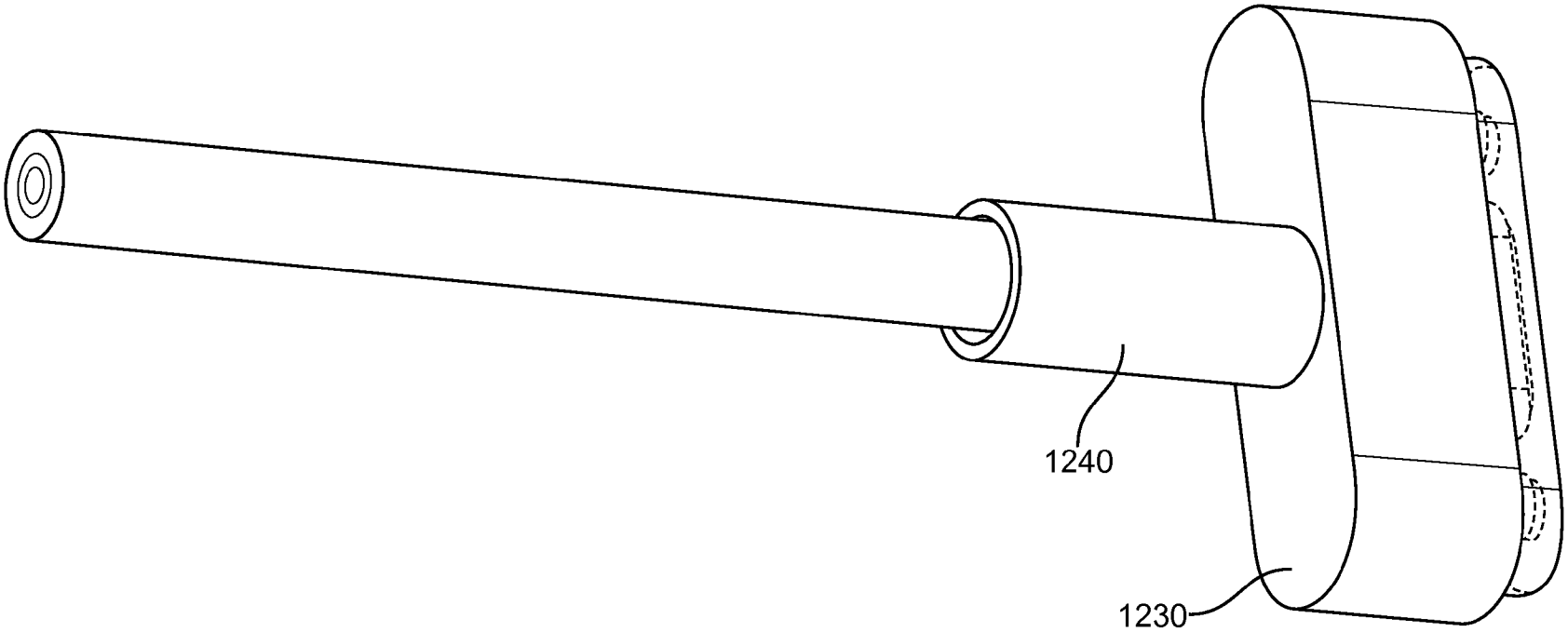
FIG. 13 illustrates a rear view of a connector insert according to an embodiment of the present invention.

FIG. 13 illustrates a rear view of a connector insert according to an embodiment of the present invention. Again, this connector insert includes shell 1230 and strain relief 1240.

Figure 14:
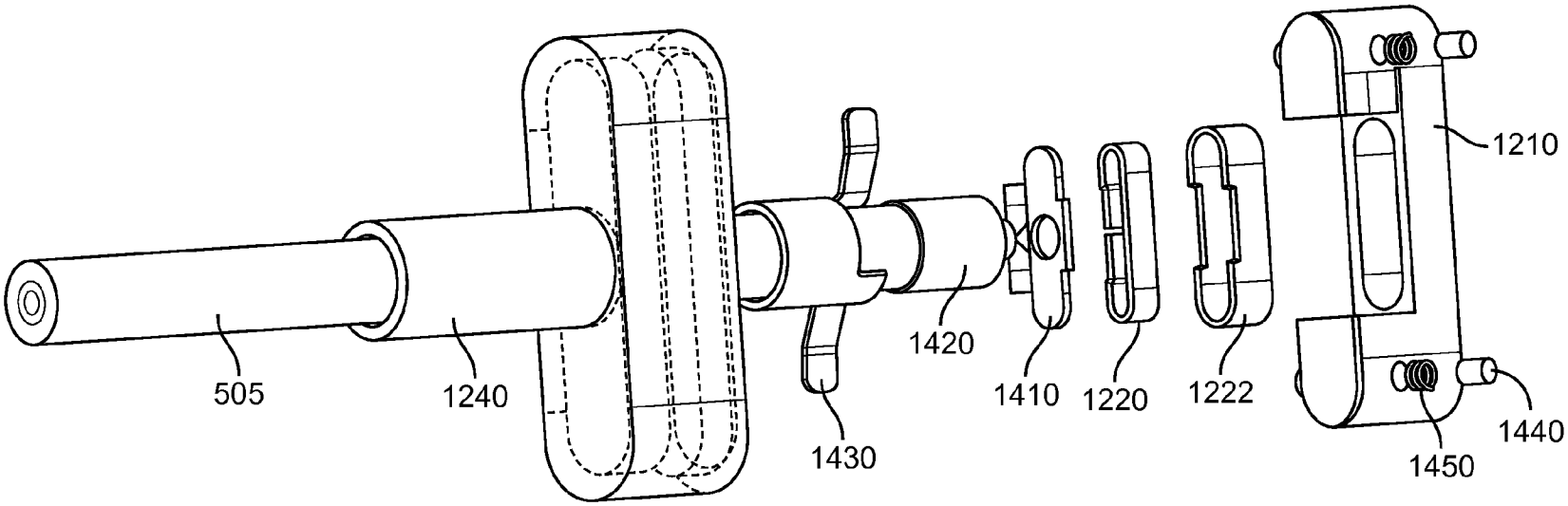
FIG. 14 illustrates an exploded view of a connector insert according to an embodiment of the present invention.

FIG. 14 illustrates an exploded view of a connector insert according to an embodiment of the present invention. This connector insert includes an attraction plate 1210, insulating portion 1222, power cap 1220, power insulator cover 1410, crimping piece 1430, shell 1230, and strain relief 1240.

Figure 15:
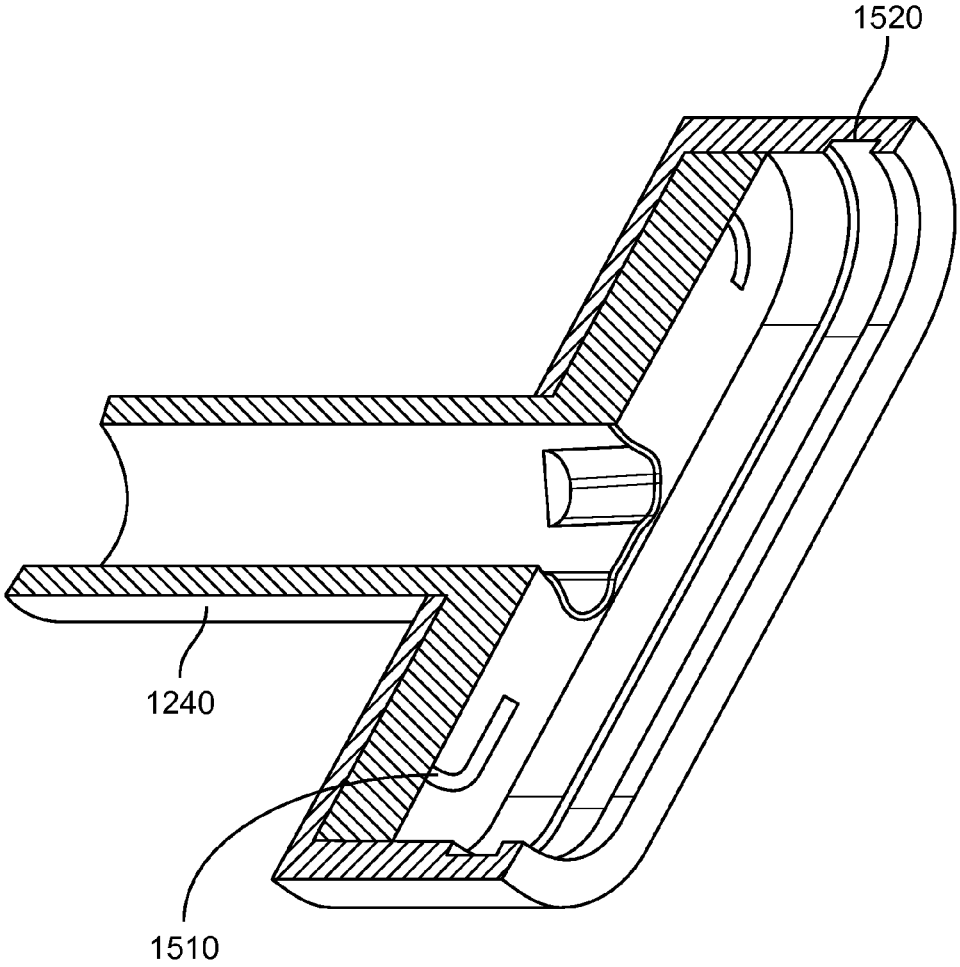
FIG. 15 illustrates a portion of a strain relief and a shell according to an embodiment of the present invention.

FIG. 15 illustrates a portion of a strain relief 1240 and a shell 1230. Strain relief 1240 includes raised portions 1510. Raised portions 1510 may apply a spring force to maintain contact between pieces of the connector insert after assembly.

During assembly, power conductors in cable 505 may be routed through power insulator 1410 and soldered to power cap 1220. Braiding 1420 may be pulled back as shown. Power cap 1220 may be placed in power insulator 1222, which is then placed in attraction plate 1210. Crimping piece 1430 may then be placed over braiding 1420. An example of this is shown in the following figure.

Figure 16:
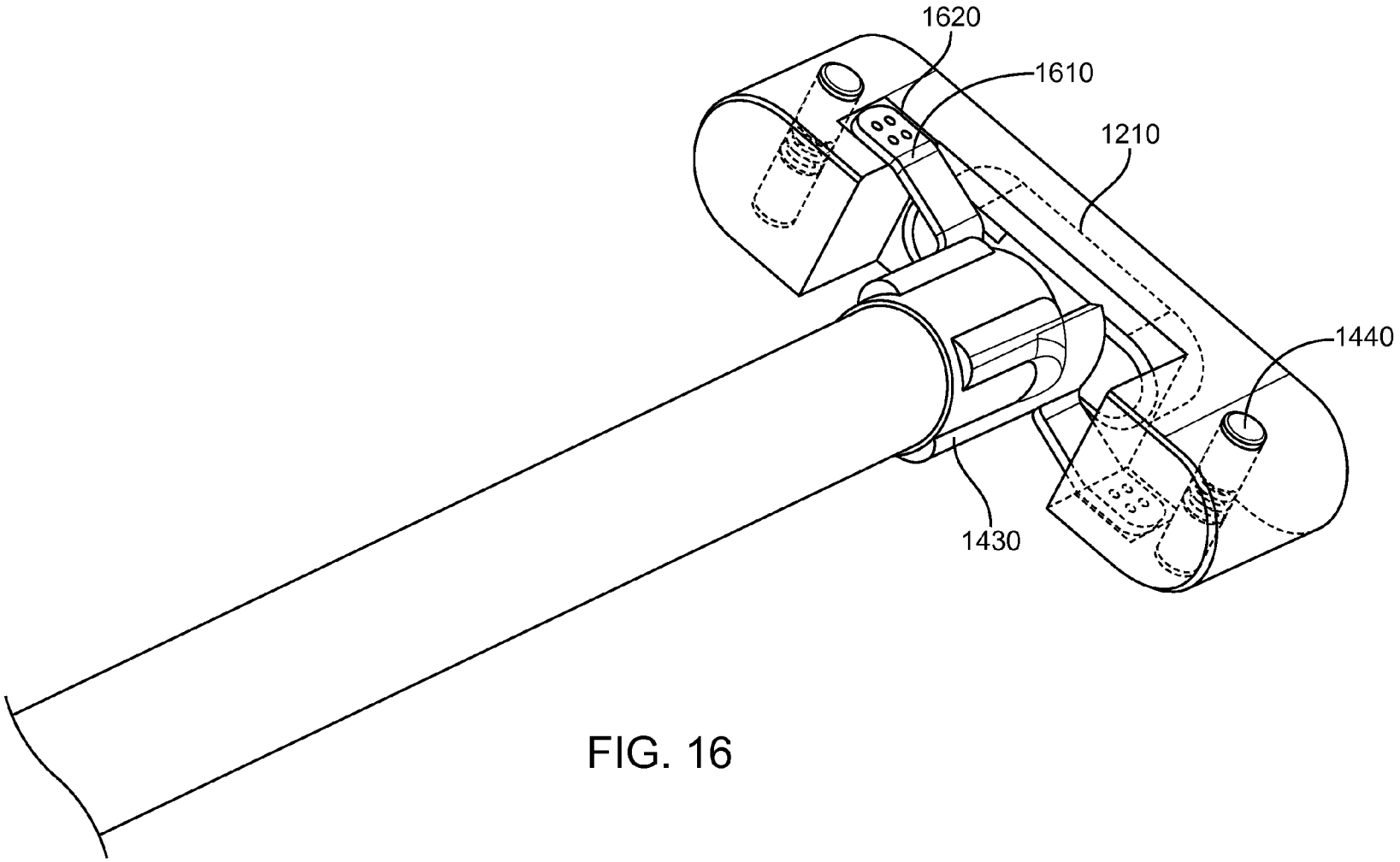
FIG. 16 illustrates portions of a connector insert according to an embodiment of the present invention.

FIG. 16 illustrates portions of a connector insert according to an embodiment of the present invention. In this example, crimping piece 1430 is engaged with attraction plate 1210. This may be accomplished during assembly by sliding crimping piece 1430 along the cable, then rotating crimping piece 1430 counter-clockwise until contact is made between arms on crimping piece 1430 and attraction plate 1210. Crimping piece 1430 may be spot welded, laser welded, soldered, or otherwise fixed at arm portion 1610 to attraction plate 1210, as shown. Attraction plate 1210 may include recess 1620 to form a step to hold arm portion 1610 more securely. Crimping piece 1430 may be crimped to form a secure connection. This crimping may be done by applying force in several directions around crimping piece at the same time. For example, four tool-die elements may b used to crimp crimping piece 1430. The resulting piece may be injection molded to secure the various pieces to each other and prevent inadvertent electrical connections from forming. Shell 1230 may then be placed over a portion of attraction plate 1210. Specifically, pins 1440 may be aligned with groove 1520 in shell 1230, as shown in FIG. 15. Attraction plate 1210 and crimping piece 1430 may be formed using low carbon steel, titanium, stainless or other steel, or other appropriate material.

In various embodiments of the present invention, it may be desirable to form a ground connection before any other connections are formed when a connector insert is attached to the connector receptacle. Similarly, during a disconnect, it may be desirable to have a ground connection be the last connection to break. This may be referred to as a make-first break-last ground connection. Such a connection may be achieved by various embodiments of the present invention. Examples are shown in the following figures.

Figure 17:
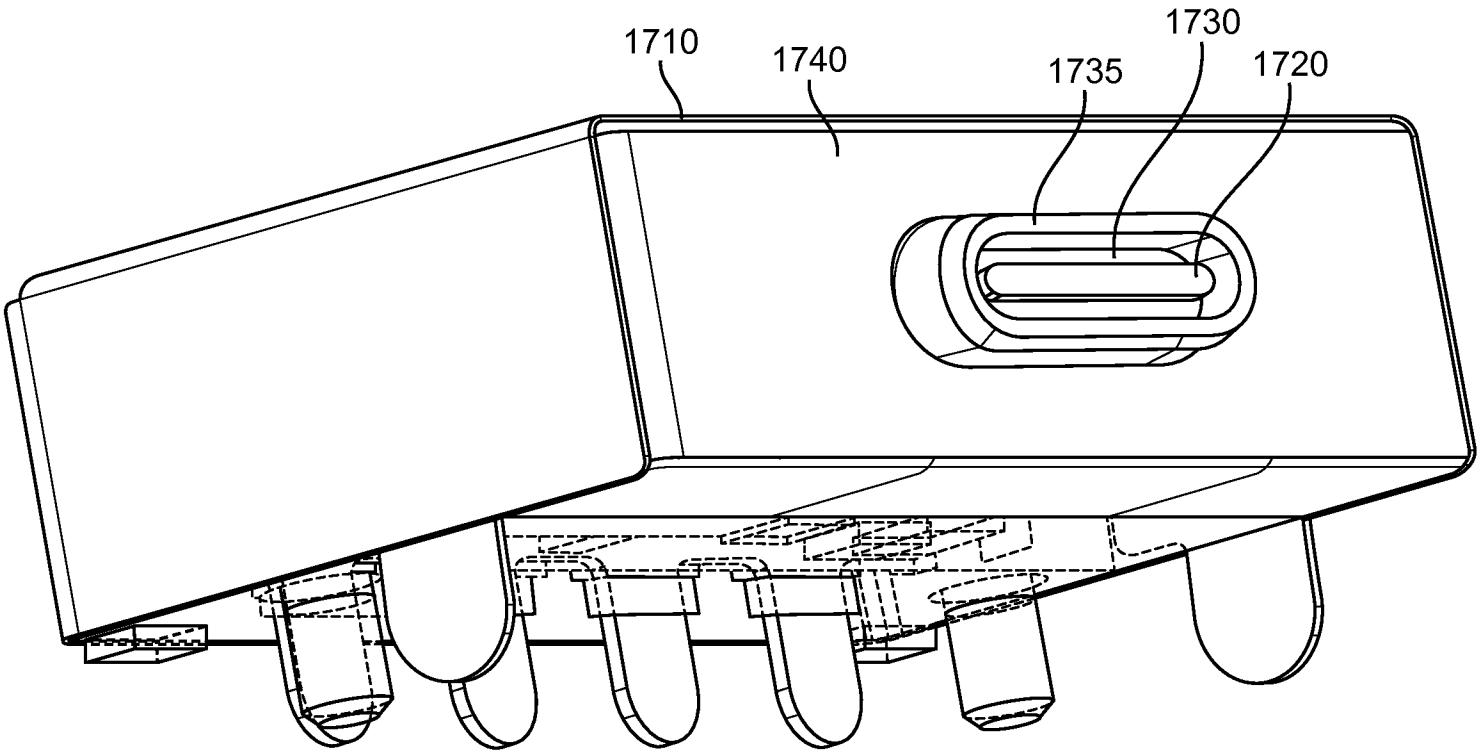
FIG. 17 illustrates a connector receptacle according to an embodiment of the present invention.

FIG. 17 illustrates a connector receptacle according to an embodiment of the present invention. This connector receptacle includes contact 1710 surrounded by a ground connection 1735. Insulating portion 1730 may isolate power contacts 1720 from ground contact 1735. Ground surface 1740 may be in contact with ground contact 1735. When a connector insert mates with this connector receptacle, ground contact 1735 is first to mate with a corresponding contact in the connector insert. Ground contact 1735 is then depressed, thereby allowing power contact 1720 to mate with a corresponding contact in the connector insert. The power contact 1720 and ground contact 1735 may be formed of a highly conductive material, such as brass, copper-nickel-silicon alloy, or a silver alloy.

Figure 18:
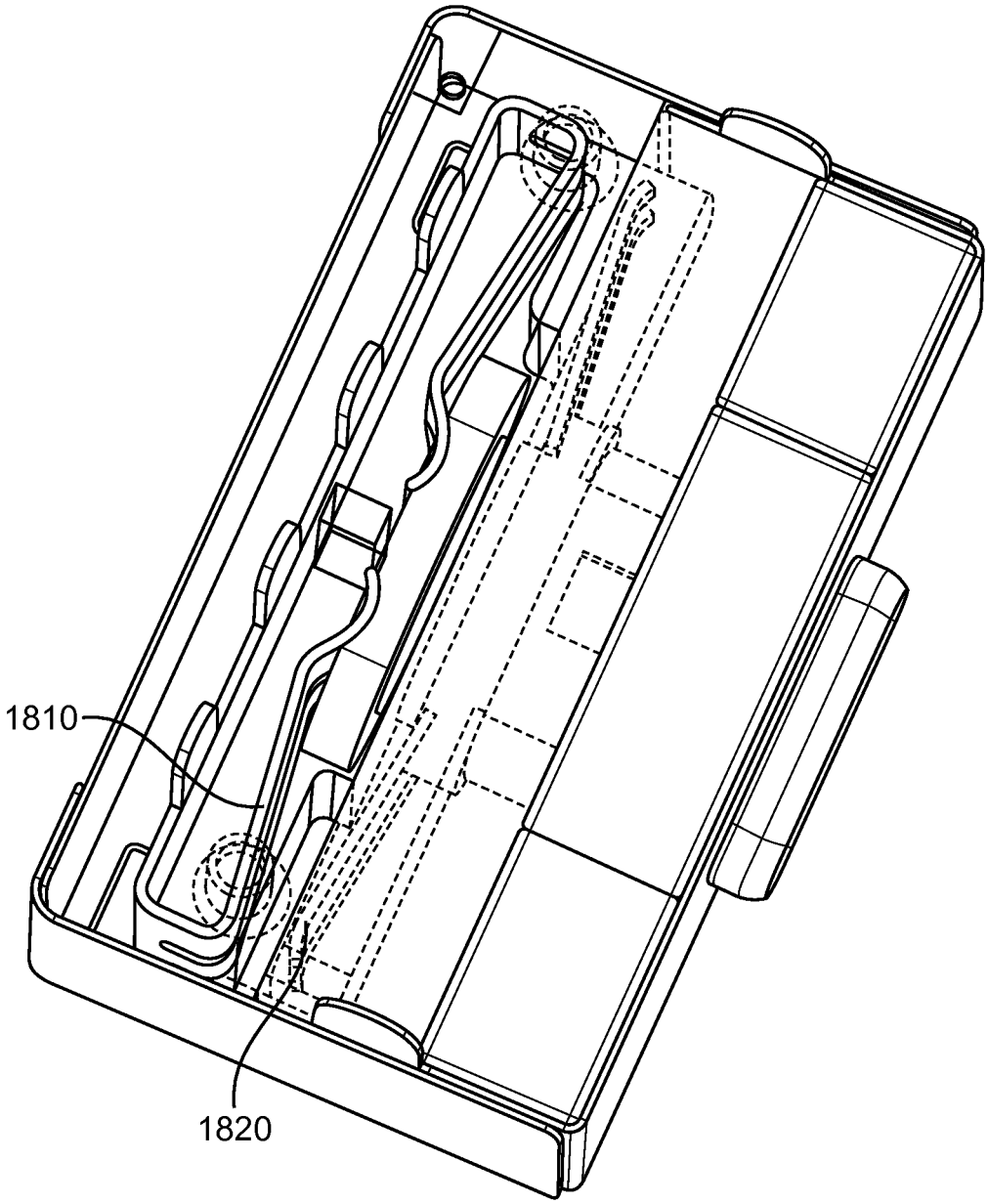
FIG. 18 illustrates a top view of the connector receptacle of FIG. 17.

FIG. 18 illustrates a top view of the connector receptacle of FIG. 17. As before, spring 1810 is provided for power contact 1720. To allow ground contact 1730 to be depressed, a second spring 1820 is included. This two-spring arrangement allows a ground contact and a power contact to be independently depressed, and allows a make-first break-last ground connection. Springs 1810 and 1820 may be formed using Titanium Copper (for example, Ti—Cu NKT322 EH), Phosphor-bronze (for example, C5210R-H), or other appropriate material.

Figure 19A:
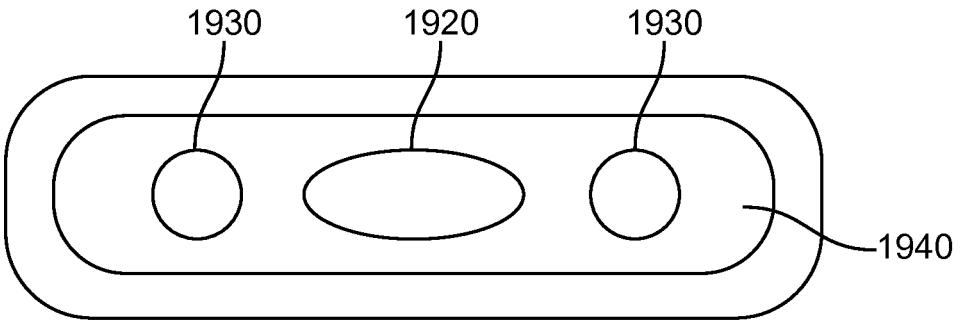
FIGS. 19A and 19B illustrate a connector receptacle and connector insert according to an embodiment of the present invention.
Figure 19B:
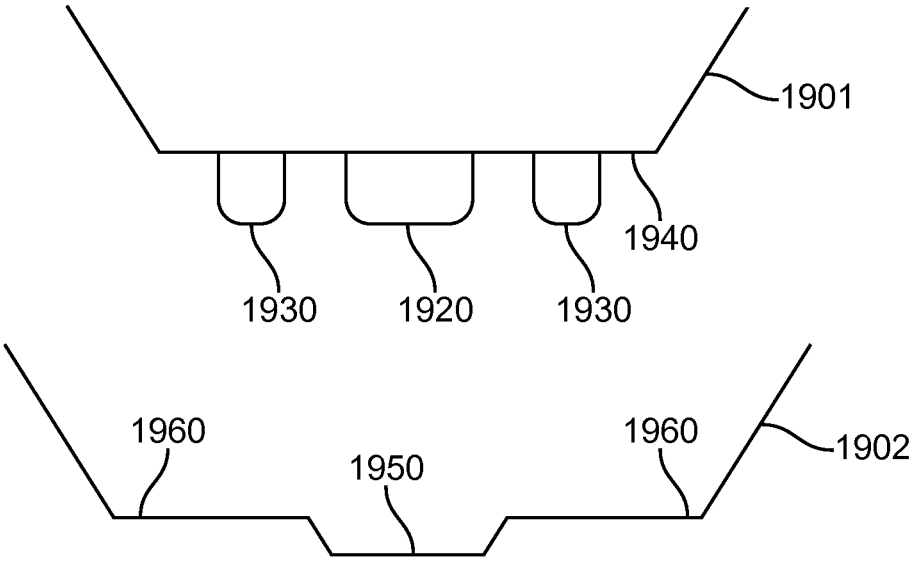

FIGS. 19A and 19B illustrate a connector receptacle and connector insert according to an embodiment of the present invention. FIG. 19A illustrates a front view of a connector receptacle having power contact 1920 and ground contacts 1930 on a mesa 1940. FIG. 19B illustrates a top view of a connector insert and a connector receptacle according to an embodiment of the present invention. Connector receptacle 1901 again has power contacts 1920 and ground contacts 1930. Connector insert 1902 includes a depressed portion 1950 to accept power contact 1920, and raised portions 1960 to accept ground contacts 1930. As connector insert 1901 engages connector receptacle 1902, ground contacts 1930 engage portions 1960 before contacts 1920 engage portion 1950. Similarly, as insert 1902 disconnects from receptacle 1901, ground contacts 1930 disconnect from portions 1960 after contacts 1920 disconnects from portion 1950.

Figure 20:
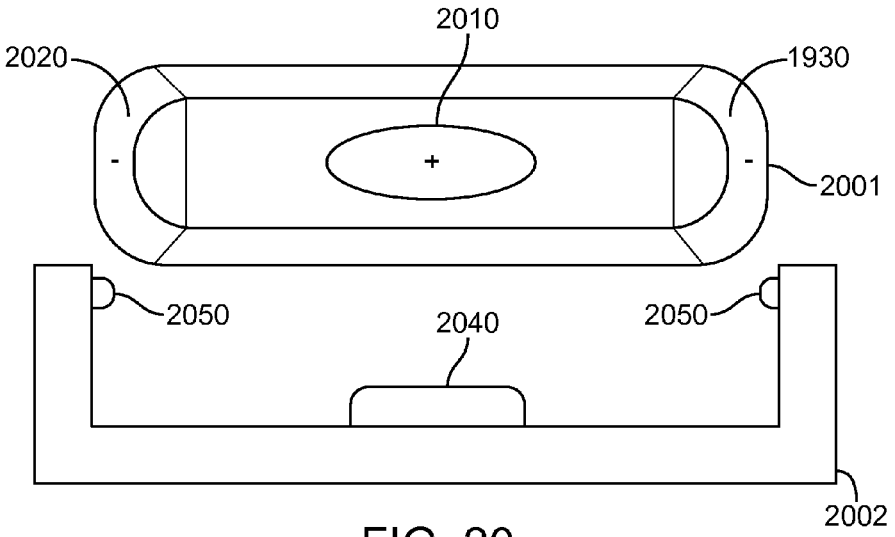
FIG. 20 illustrates a connector receptacle and a connector insert according to an embodiment of the present invention.

FIG. 20 illustrates a connector receptacle and a connector insert according to an embodiment of the present invention. This figure includes a connector receptacle 2001 and connector insert 2002. In this example, as insert 2002 engages receptacle 2001, ground contacts 2050 engage ground contacts 2020 before power contact 2040 engages power contact 2010.

Figure 21:
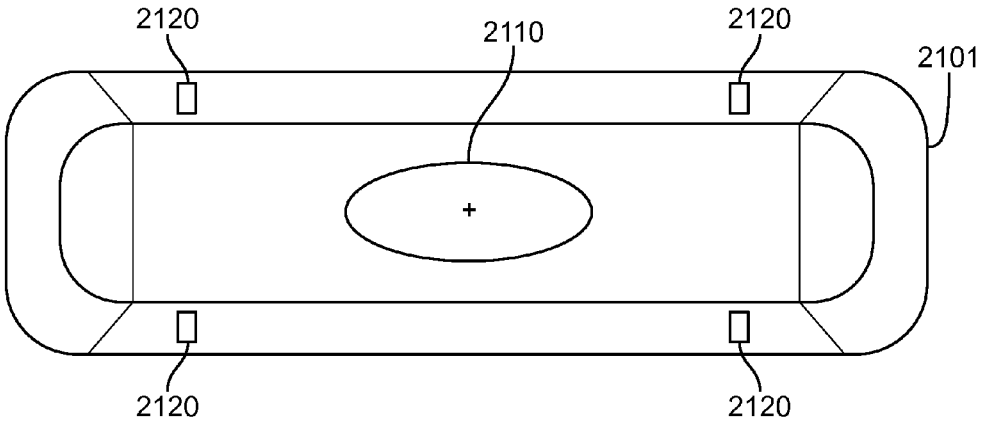
FIG. 21 illustrates another connector receptacle according to an embodiment of the present invention.

FIG. 21 illustrates another connector receptacle according to an embodiment of the present invention. In this example, ground contacts 2120 lead power contact 2110 to form a make-first break-last ground path.

Figure 22:
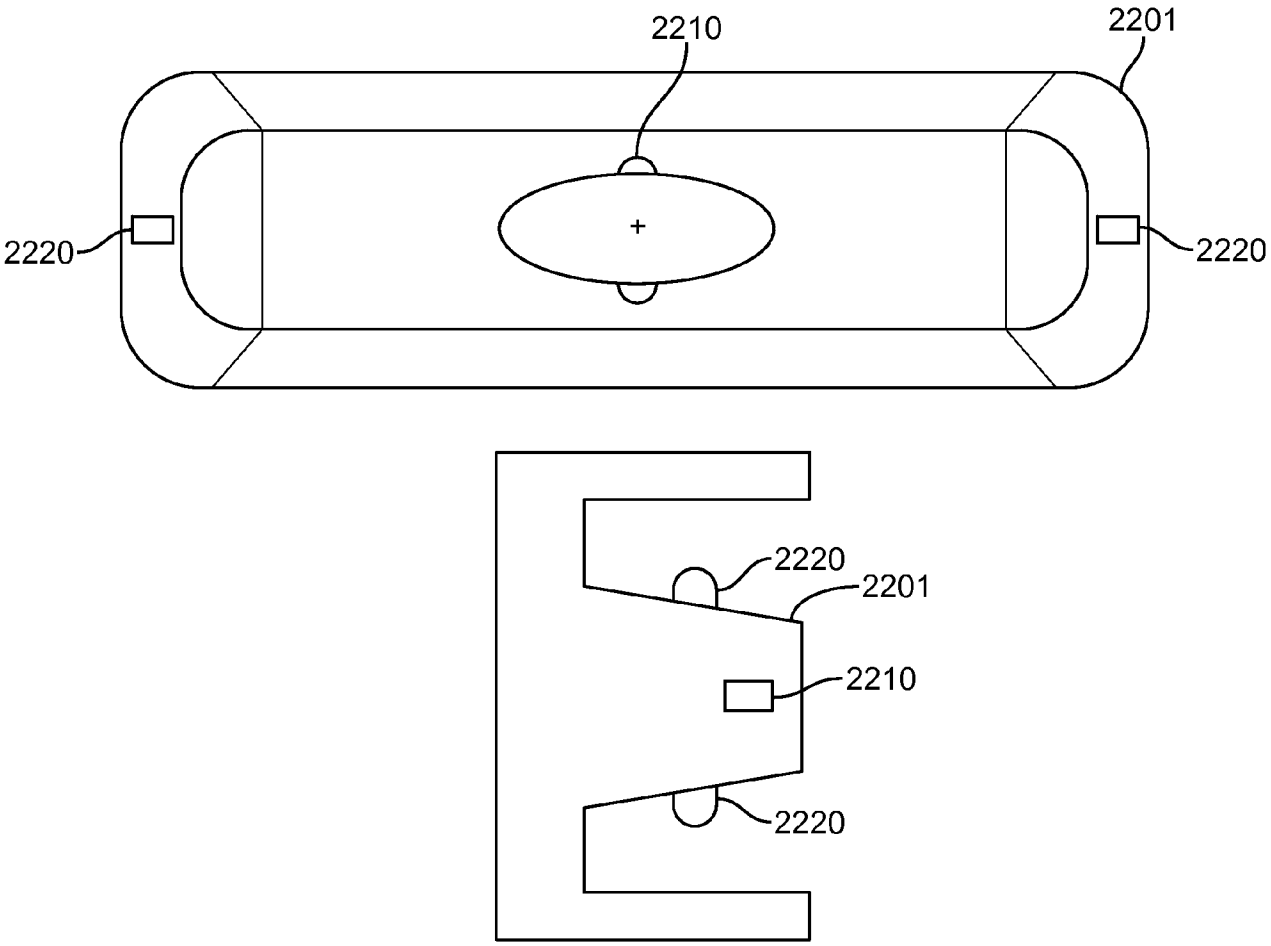
FIG. 22 illustrates a connector receptacle according to an embodiment of the present invention.

FIG. 22 illustrates a connector receptacle according to an embodiment of the present invention. Connector receptacle 2201 includes power contacts 2220 and ground contacts 2210. In this example, ground contacts 2210 are placed in front of power contacts 2220, such that they engage corresponding ground contacts in a connector insert before power contacts 2220 engage corresponding power contacts in the connector insert.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a plurality of magnets arranged at a face of the connector receptacle;

a ground return at the face of the connector receptacle and covering the plurality of magnets such that the ground return is between a connector insert and the plurality of magnets when the connector insert is mated with the connector receptacle;

a depressible power contact having a first end extending beyond the face of the connector receptacle and a second end extending behind the plurality of magnets;

a spring at the second end of the depressible power contact and fixed relative to the ground return, and a stop positioned to limit a distance the depressible power contact can be depressed.

2. The connector receptacle of claim 1 wherein the plurality of magnets comprises at least four magnets, the at least four magnets arranged to have opposing polarities.

3. The connector receptacle of claim 1 wherein the plurality of magnets comprises three magnets, the three magnets arranged to have opposing polarities.

4. The connector receptacle of claim 1 wherein the ground return is formed as part of a shield around the connector receptacle.

5. The connector receptacle of claim 1 wherein the ground return is curved.

6. The connector receptacle of claim 1 wherein the ground return is substantially planar.

7. The connector receptacle of claim 1 wherein the ground return is formed of a material having a low magnetic conductivity.

8. The connector receptacle of claim 1 wherein the power contact is formed of a highly conductive material.

9. The connector receptacle of claim 1 wherein the stop is attached to the spring.

10. The connector receptacle of claim 1 wherein the spring substantially forms an elongated loop.

11. The connector receptacle of claim 10 wherein the spring compresses when the power contact is depressed relative to the ground return.

12. The connector receptacle of claim 11 wherein the stop is located on the spring.

13. A connector insert comprising:

a cable having braiding and a power conductor, where the power conductor emerges from a first end of the cable and the braiding is pulled back around the cable at the first end of the cable;

an insulating layer at the first end of the cable having an opening for the power conductor;

a power cap fixed to the power conductor such that the insulating layer is between the first end of the cable and the power cap;

a power insulator around sides of the power cap;

an attraction plate around the power insulator;

a crimping piece over the braiding and secured to the attraction plate; and a shell over a rear portion of the attraction plate, wherein the attraction plate is fixed to the shell by a plurality of pins in the attraction plate fit into a groove in the shell.

14. The connector insert of claim 13 wherein the attraction plate is formed of a ferromagnetic material.

15. The connector insert of claim 13 wherein the pins are spring biased.

16. A connector receptacle comprising:

a plurality of magnets arranged at a face of the connector receptacle;

a shield at the face of the connector receptacle and covering the plurality of magnets, such that the ground return is between a connector insert and the plurality of magnets when the connector insert is mated with the connector receptacle;

a power contact having a first end extending beyond the face of the connector receptacle and a second end extending behind the plurality of magnets;

a ground contact formed around sides of the power contact and having a first end extending beyond the face of the connector receptacle and a second end extending behind the plurality of magnets;

a first spring at the second end of the power contact and fixed relative to the shield; and a second spring at the second end of the ground contact and fixed relative to the shield.

17. The connector receptacle of claim 16 wherein the plurality of magnets comprises at least four magnets, the at least four magnets arranged to have opposing polarities.

18. The connector receptacle of claim 16 wherein the plurality of magnets comprises three magnets, the three magnets arranged to have opposing polarities.

19. The connector receptacle of claim 16 wherein the ground contact extends beyond the power contact.

20. The connector receptacle of claim 16 wherein the ground contact is arranged to mate with a corresponding contact on a connector insert before the power contact mates with a corresponding contact on the connector insert with the connector insert is brought into proximity with the connector receptacle.

* * * * *